US010278502B2

(12) United States Patent
Farahani

(10) Patent No.: US 10,278,502 B2
(45) Date of Patent: May 7, 2019

(54) PORTABLE COLLAPSABLE SHELF AND METHOD OF USE

(71) Applicant: Sheila Farahani, Austin, TX (US)

(72) Inventor: Sheila Farahani, Austin, TX (US)

( * ) Notice: Subject to any disclaimer, the term of this patent is extended or adjusted under 35 U.S.C. 154(b) by 0 days.

(21) Appl. No.: 15/852,843

(22) Filed: Dec. 22, 2017

(65) Prior Publication Data

US 2018/0177298 A1 Jun. 28, 2018

Related U.S. Application Data

(60) Provisional application No. 62/438,393, filed on Dec. 22, 2016.

(51) Int. Cl.

| | |
|---|---|
| ***A47B 96/02*** | (2006.01) |
| ***A47D 5/00*** | (2006.01) |
| ***A47B 23/02*** | (2006.01) |
| ***A47B 23/04*** | (2006.01) |
| *A47B 45/00* | (2006.01) |
| *A47B 43/00* | (2006.01) |
| *A47B 1/06* | (2006.01) |

(52) U.S. Cl.

CPC ..... *A47B 96/025* (2013.01); *A47B 23/02* (2013.01); *A47B 23/04* (2013.01); *A47D 5/006* (2013.01); *A47B 1/06* (2013.01); *A47B 43/00* (2013.01); *A47B 45/00* (2013.01); *A47B 96/021* (2013.01); *A47B 2200/0085* (2013.01)

(58) Field of Classification Search

CPC ..... A47B 96/025; A47B 23/02; A47B 23/04; A47B 45/00; A47B 43/00; A47B 1/06; A47B 96/021; A47B 2200/0085; A47D 5/006

USPC ..... 211/149, 86.01, 119.003, 119.005, 113, 211/118; 108/67, 193, 134, 135, 152; 248/236, 238, 235, 239–246, 250

See application file for complete search history.

(56) References Cited

U.S. PATENT DOCUMENTS

| | | | | | |
|---|---|---|---|---|---|
| 94,447 | A * | 8/1869 | Sherman | A47B 1/06 | 108/68 |
| 154,126 | A * | 8/1874 | Cotton | A47B 23/002 | 108/43 |
| 981,114 | A * | 1/1911 | Ridgely | 108/116 | |
| 1,108,692 | A * | 8/1914 | Burd | A47B 13/16 | 108/97 |
| 1,126,611 | A * | 1/1915 | Wright | 108/14 | |

(Continued)

*Primary Examiner* — Jonathan Liu
*Assistant Examiner* — Devin K Barnett
(74) *Attorney, Agent, or Firm* — Hulsey P.C.

(57) ABSTRACT

The present disclosure relates to a collapsible shelf comprising a platform that may include a plurality of interconnected support segments wherein the interconnected support segments are arranged to be alternately collapsed into a storage configuration and deployed into a use configuration in which said plurality of support segments lie side to side in a common plane, and a first support segment; a counterbalance attached to said first support segment; and a strut that may include a plurality of strut segments wherein the strut segments are interconnected and arranged such that the strut segments can be alternately collapsed into said storage configuration and deployed into said use configuration in which said plurality of strut segments lie side to side, a first strut segment connected to said first support segment, and an end strut segment.

3 Claims, 4 Drawing Sheets

(56) References Cited

U.S. PATENT DOCUMENTS 1,171,826 A * 2/1916 Abramson ..... A47B 23/02 108/1
1,884,160 A * 10/1932 Orlick ..... B60N 3/007 108/101
1,955,769 A * 4/1934 Reynolds ..... G09F 5/02 108/99
2,205,193 A * 6/1940 Goldman ..... A47B 43/006 108/135
2,473,086 A * 6/1949 Gonzalez ..... A47G 29/083 211/86.01
2,516,760 A * 7/1950 Doran ..... A45C 13/40 211/85.3
2,525,405 A * 10/1950 Feiertag ..... G06K 21/04 209/612
2,546,556 A * 3/1951 Miller ..... F16L 3/24 211/60.1
2,839,201 A * 6/1958 Auster ..... B67D 7/38 211/126.1
2,956,689 A * 10/1960 Der Togt ..... B29C 63/18 211/104
2,961,101 A * 11/1960 Hutton ..... A47F 5/108 211/132.1
3,186,673 A * 6/1965 Olson ..... A47B 31/06 211/86.01
3,269,555 A * 8/1966 Henderson ..... B60N 3/08 108/47
3,433,443 A * 3/1969 Beeson ..... A47B 43/00 211/149
3,677,203 A * 7/1972 Barrineau ..... A47F 5/0037 108/166
3,741,131 A * 6/1973 Leadbetter ..... A47B 5/02 108/152
3,762,673 A * 10/1973 Koslovsky ..... A61J 1/16 108/26
3,832,957 A * 9/1974 Mendenhall ..... A47B 96/021 108/108
4,084,703 A * 4/1978 Hossalla ..... A47B 96/025 108/137
4,194,714 A * 3/1980 Schultz ..... A45C 15/00 116/137 R
4,958,577 A * 9/1990 Demaio ..... A47B 23/002 108/166
5,458,301 A * 10/1995 Cournoyer ..... A47G 29/083 248/100
5,594,419 A * 1/1997 Lo ..... A47G 29/083 248/339
7,096,797 B2 * 8/2006 Sharpe ..... A47B 3/00 108/43
7,322,554 B2 * 1/2008 Caroselli ..... A47G 29/083 223/120
8,002,225 B1 * 8/2011 Malone ..... A47B 81/00 211/118
8,322,545 B1 * 12/2012 Golias, Jr. ..... A47B 96/021 211/119.003
9,215,952 B2 * 12/2015 Leconte ..... A47J 43/20
10,104,965 B1 * 10/2018 Miller ..... A47B 96/024
2004/0108432 A1 * 6/2004 Weitzman ..... A47G 29/083 248/339
2004/0195484 A1 * 10/2004 Sheeran ..... A47G 29/083 248/304
2006/0196841 A1 * 9/2006 Price ..... A47F 5/00 211/86.01
2007/0227991 A1 * 10/2007 Brustein ..... A47G 29/083 211/119.005
2008/0083862 A1 * 4/2008 Salatka ..... A47G 29/083 248/308
2009/0294387 A1 * 12/2009 Spencer ..... A63D 15/10 211/68
2010/0044324 A1 * 2/2010 Gerace ..... A47B 81/061 211/26.2
2010/0109381 A1 * 5/2010 Plavetich ..... B60R 9/00 296/193.01
2012/0080393 A1 * 4/2012 Eisman ..... A47B 43/00 211/86.01
2015/0021284 A1 * 1/2015 Ashley ..... A63F 1/067 211/85.7
2015/0265069 A1 * 9/2015 Brinton, Jr. ..... A47B 96/02 211/119.003
2015/0296977 A1 * 10/2015 Calderone ..... A47B 23/025 5/2.1
2017/0156493 A1 * 6/2017 Trujillo ..... A47B 46/00

* cited by examiner

PORTABLE COLLAPSABLE SHELF AND METHOD OF USE

This U.S. Non-Provisional Patent Application claims priority to the U.S. Provisional Patent Application No. 62/438,393 filed on Dec. 22, 2016 which is hereby incorporated by reference in its entirety. The present disclosure relates to a portable and collapsible shelf.

FIELD OF THE INVENTION

Background of the Invention

Public surfaces such as baby changing tables, or coffee shop tables, often have limited space or can lack a flat surface to place items on. Because these surfaces are so rarely used, and typically owned by someone else, modifying the surface in a permanent way is too time consuming and cost prohibitive. Furthermore, the cleanliness of the public surfaces is never certain.

In other situations, a surface area might not be big enough for one more item, but the need to place another item on the surface might not be great enough to necessitate permanently modifying the surface. Additionally, the surrounding space might not allow for a larger permanent surface.

The need remains for a device that has certain improved features allowing for temporarily providing an extra surface area on a flat surface such as a baby changing table or a table in a public space.

BRIEF SUMMARY OF THE INVENTION

The disclosed subject matter allows for temporarily creating extra flat surface space that extends from a relatively flat surface or wall. The present disclosure additionally has the advantage of being collapsible into a smaller size to allow ease of portability.

BRIEF DESCRIPTION OF THE DRAWINGS

The novel features believed characteristic of the disclosed subject matter will be set forth in any claims that are filed later. The disclosed subject matter itself, however, as well as a preferred mode of use, further objectives, and advantages thereof, will best be understood by reference to the following detailed description of an illustrative embodiment when read in conjunction with the accompanying drawings, wherein:

DETAILED DESCRIPTION OF ILLUSTRATIVE EMBODIMENTS

Reference now should be made to the drawings, in which the same reference numbers are used throughout the different figures to designate the same components.

Figure 1:
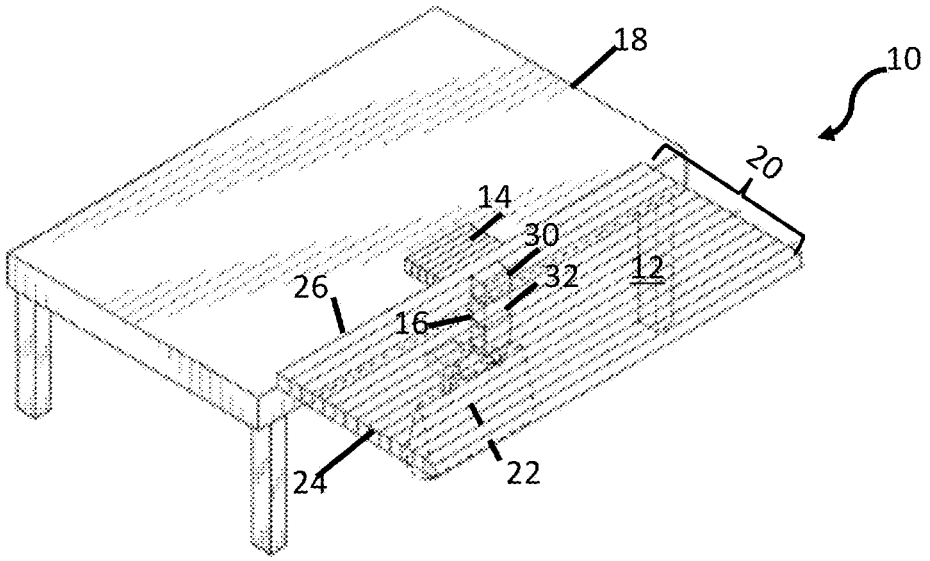
FIG. 1 depicts a view of an embodiment of the inventive subject matter in use configuration.

FIG. 1 generally depicts a collapsible shelf 10, having a platform 12, a counter-balance 14, and a strut 16 deployed on a table 18 and providing a flat surface 20 for placing items. A purse 22 is visibly hanging from the strut 16.

The platform 12, comprises a plurality of interconnected support segments 24, and a first support segment 26. The interconnected support segments 24, along with the first support segment 26 may be interconnected through interlocking design aspects and or hinges, to allow the platform 12 to collapse in one direction and resist collapsing in the opposite direction. The support segments 24 are preferably a rigid material such as plastic, wood, or metal.

The counter-balance 14 is attached to the first support segment 28 to provide a non-permanent attachment to the table 18 and provide support to prevent the platform 12 from collapsing under the weight of items placed on top of it. The counter-balance 14 is preferably a rigid and dense material. Embodiments of the counter-balance may be comprised of any dense material, or any material that provides resistance to prevent the collapse of the platform. Alternatively, some embodiments of the counter-balance 14 may comprise suction cups, or magnetic material.

The strut 16, comprising a first strut segment 30, a plurality of interconnected strut segments 32, and an end strut segment 34. The first strut segment 30 is attached to the first support segment 28 and provides a for an upturned end strut segment 32 allowing a purse or other item to be hung on the strut 16 and add additional counter-balance to prevent the platform 12 from collapsing. The strut 16, is preferably a rigid material, having hinges and or an interconnected design component to connect the interconnected strut segments 32. However, other alternatives are contemplated. For example, strut 16 can have a rubber surface, a non-slip surface, or a magnetic material on portions of a strut segment. In some embodiments, the first strut 16 segment may comprise a spring loaded prong having a first-end and a second-end. The first end attaches to the first strut segment 30 in a manner allowing the prong to pivot from a parallel position with the first strut segment to a position perpendicular with the first strut segment. The prong is spring loaded, allowing the prong to store kinetic energy when pivoted away from the first strut segment. The stored kinetic energy then provides a force maintaining stability of the platform while the second end of the prong is in contact with a table surface.

Figure 2:
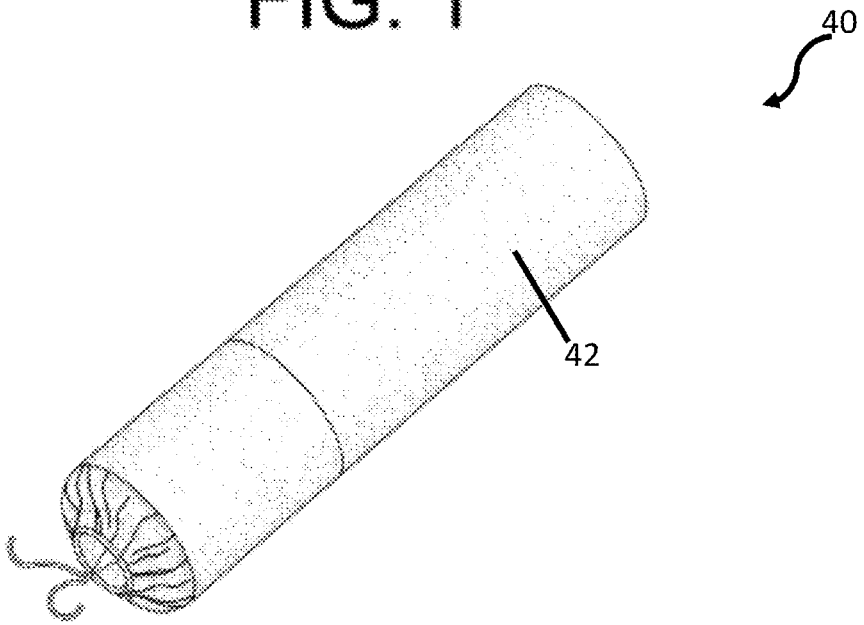
FIG. 2 depicts a view of an embodiment of the inventive subject matter in storage configuration encased in a carrying case.

FIG. 2 generally depicts the collapsible shelf 10 in a storage configuration 40 and surrounded by a carrying bag 42. The storage configuration 40 is enabled by the collapsible interconnected strut segments 30 and the collapsible interconnected support segments 28. The collapsible shelf 10 collapses around itself enabling a storage configuration 40 as depicted.

Optionally, the storage configuration 40 may further be enabled by a magnetic component or material on the strut, which could allow the collapsible shelf to maintain the storage configuration without being encapsulated inside a container such as a bag as depicted in FIG. 2.

Figure 3:
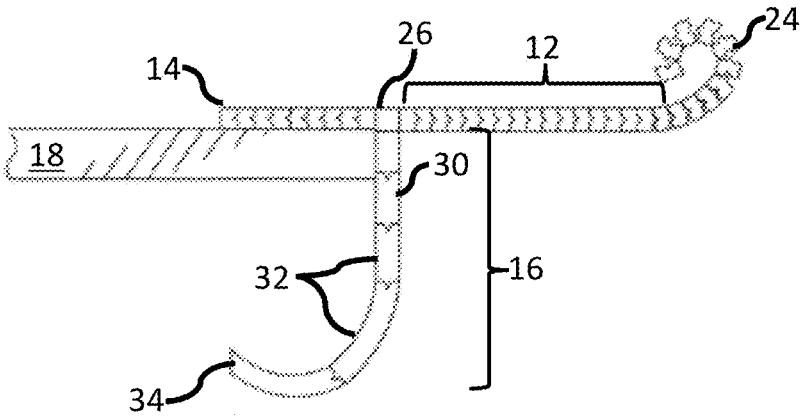
FIG. 3 depicts a side view of an embodiment of the inventive subject matter in a use configuration.

FIG. 3 generally depicts a side view of the collapsible shelf 10 depicted in FIG. 1. In one embodiment, the counter-balance 14 may extend at least as far as the strut allow the center of mass to be directed into the table, and not into the shelf when the shelf is loaded.

In one embodiment the strut may comprise a curve or change in direction of the strut from a downward angle to an upward angle. This would enable the use of the strut 16 as a hook to hang items on. Items may include a purse, a diaper changing bag, or an electronics bag.

Figure 4:
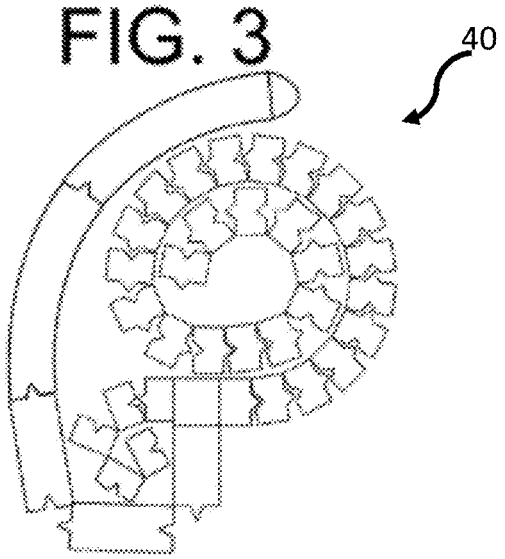
FIG. 4 depicts a side view of an embodiment of the inventive subject matter in a storage configuration.

FIG. 4 generally depicts the collapsible shelf 10 in a storage configuration 40. An embodiment may provide for the strut encircling the entire collapse platform and counter-balance. In other embodiments, the strut may only encircle a portion of the counter-balance and platform. Alternative embodiments may provide for the platform encircling the counter-balance and/or the strut.

Figure 5:
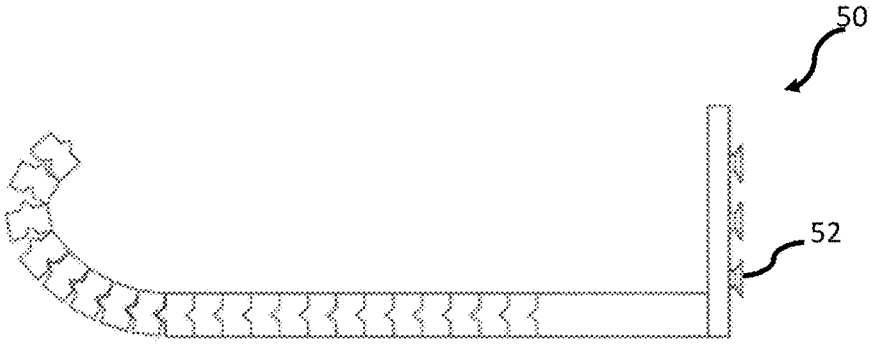
FIG. 5 depicts a side view of an embodiment of the inventive subject matter showing only the platform and counter-balance with suction cups.
Figure 6:
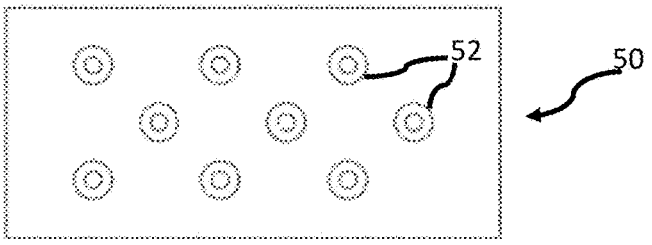
FIG. 6 depicts a frontal view of an embodiment of the counter-balance having suction cups.

FIG. 5 generally depicts a side view of an embodiment of the inventive subject matter having a counter-balance with suction cups 52. FIG. 6 depicts a front view of the counter-balance with suction cups 52.

Figure 7:
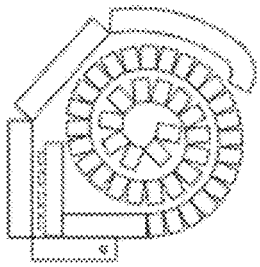
FIG. 7 depicts a side view of an embodiment of the inventive subject matter in a storage configuration.
Figure 8:
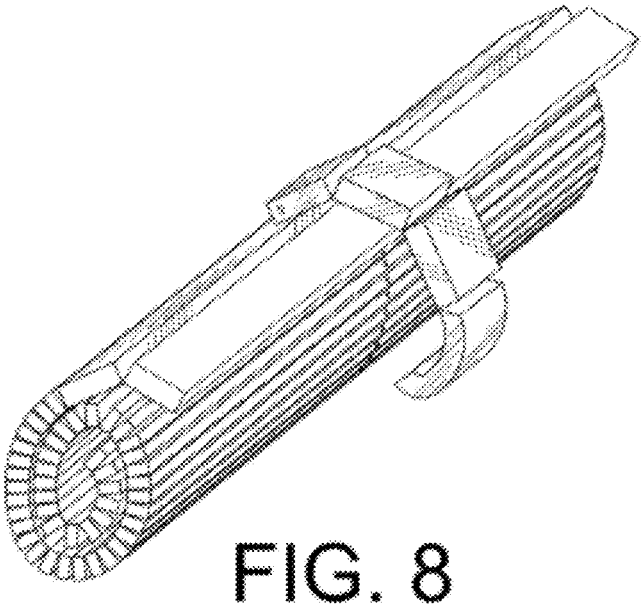
FIG. 8 depicts a perspective view of view of an embodiment of the inventive subject matter in a storage configuration.

FIG. 7 illustrates a side view of a storage configuration of an alternative embodiment. FIG. 8 additionally depicts an embodiment of a storage configuration from an elevated perspective view.

EXAMPLES

The following examples illustrate an embodiment of the present inventive subject matter but are not intended to limit the scope of the inventive subject matter.

In one example of the inventive subject matter the portable collapsible shelf 10 is collapsed into the storage configuration 40. The strut 16 may be collapsed such that a strut segment 28 may have a first magnetic component that magnetically connects to a second magnetic component of the platform 12. In this example, the first magnetic component of the strut segment 28 and the second magnetic component of the platform 12 may be comprised of metal, a magnet, a magnetic material, a rare-earth metal, a rare-earth magnet, or a material that has been magnetized. Additionally, the first and second magnetic component may be comprised of any material that allows for the first and second magnetic components to create a magnetic field to resist being pulled apart until enough force is applied to separate the first and second magnetic component.

In another example of the inventive subject matter the portable collapsible shelf 10 is expanded into the use configuration and placed in physical contact with sufficiently flat surface such as a diaper changing table, or a public table in a public space. The strut is expanded and engaged with a second surface that may be a wall, table leg, table support beam, or another surface that is perpendicular to the sufficiently flat surface. In this example, the point of contact on the strut, where the strut meets the second surface, may be a non-slip surface to increase stability and reduce the likelihood of the strut slipping and causing the platform to collapse because of a lack of support from the strut. The point of contact with the non-slip surface might be one end of the strut, along the length of the strut, or may be any point on the strut.

In another example of the inventive subject matter the portable collapsible shelf may have a platform that when extended into the use configuration may have one or more hinges along the side of the interconnected support segments that is perpendicular to a table or flat surface the apparatus is in contact with. The hinges may allow a plurality of interconnected support segments to change positions from being stacked vertically above the platform and a plurality of interconnected support segments to a position in parallel with and within the same plane as the platform and a plurality of interconnected support segments. In this example, the hinged plurality of interconnected support segments may allow for an increase of surface area of the platform and a more compact apparatus while in the storage configuration.

In some embodiments, the inventive subject matter may comprise a three-pronged pincer type grasp. The grasp would attach to the first support segment. The prongs may be spring loaded. In one embodiment, a first and second prong of the three-pronged pincer type grasp would contact the top surface of a table, and a third prong would contact the bottom surface of the table. This position would provide more stability to the platform by gripping the table with more force, thus preventing movement of the platform.

In an alternative embodiment, a single-prong is attached to the first support segment, and would contact the table or other surface on the bottom surface or opposite surface that the counter-balance contacts. The single-prong may be spring loaded. The single-prong may also be collapsible.

In one embodiment, a method for placing items on a collapsible shelf comprises unrolling a collapsible shelf into a use configuration, placing a counter-balance on a surface; extending a strut beneath the platform; and placing an object on the platform. The method may further comprise placing a purse or bag on the strut. Then, removing the object from the platform; collapsing the strut; removing the counter-balance from the surface; and collapsing the platform. After collapsing the collapsible shelf into a storage configuration, the collapsible shelf may be placed into a bag for transport or storage.

The present invention may be embodied in other forms without departing from the spirit and the essential attributes thereof, and, accordingly, reference should be made to the appended claims, rather than to the foregoing specification, as indicating the scope of the invention.

What is claimed is:

1. A collapsible shelf comprising:

a platform comprising:

a plurality of interconnected support segments wherein the interconnected support segments are movable between a storage configuration wherein the support segments are roll into a multi-layered coil and an extended configuration in which said plurality of support segments lie side to side and parallel to each other and parallel to a counter-balance in a common plane, wherein the platform defines a first width and a first length in the extended configuration, wherein the platform is configured to support an object thereon in the extended configuration;

the counter-balance is attached to a rear portion of said platform, wherein the counter-balance defines a second width and a second length, wherein the first width is larger than the second width and the first length is larger than the second length, wherein the counter-balance is configured to rest upon a support surface so that the platform is cantilevered therefrom; and a strut comprising:

a plurality of strut segments wherein the strut segments are interconnected and arranged such that the strut segments are movable between a storage position and an extended position in which said plurality of strut segments extend downwardly from said platform, wherein the strut is configured to abut an edge of the support surface in the extended position to further support suspending the platform from the support surface.

2. The collapsible shelf of claim 1, wherein the strut has a non-slip surface.

3. The collapsible shelf of claim 1, wherein the strut comprises a magnetic material.

* * * * *